US010792540B2

(12) United States Patent
Campbell

(10) Patent No.: US 10,792,540 B2
(45) Date of Patent: Oct. 6, 2020

(54) WATER SPORTS NASAL GUARD

(71) Applicant: Wesley H. Campbell, Highland Haven, TX (US)

(72) Inventor: Wesley H. Campbell, Highland Haven, TX (US)

( * ) Notice: Subject to any disclaimer, the term of this patent is extended or adjusted under 35 U.S.C. 154(b) by 756 days.

(21) Appl. No.: 15/331,242

(22) Filed: Oct. 21, 2016

(65) Prior Publication Data

US 2017/0113099 A1 Apr. 27, 2017

Related U.S. Application Data

(60) Provisional application No. 62/244,874, filed on Oct. 22, 2015.

(51) Int. Cl.

| | |
|---|---|
| ***A63B 33/00*** | (2006.01) |
| ***A63B 71/08*** | (2006.01) |
| ***A63B 71/10*** | (2006.01) |

(52) U.S. Cl.

CPC ..... *A63B 33/00* (2013.01); *A63B 71/085* (2013.01); *A63B 71/10* (2013.01); *A63B 2071/086* (2013.01); *A63B 2071/088* (2013.01); *A63B 2244/19* (2013.01); *A63B 2244/20* (2013.01)

(58) Field of Classification Search

CPC . A63B 33/00; A63B 71/085; A63B 2071/088; A63B 2071/086; A63B 71/10; A63B 2244/19; A63B 2244/20; B63C 11/12; B63C 11/18; A61F 2005/563; A61F 5/56; A61F 5/566; A61F 5/08; A61F 5/05891

USPC ..... 128/858–863

See application file for complete search history.

(56) References Cited

U.S. PATENT DOCUMENTS

| | | | | |
|---|---|---|---|---|
| 2,245,432 A * | 6/1941 | Davis | G10D 7/02 | 84/330 |
| 5,692,523 A * | 12/1997 | Croll | A63B 71/085 | 128/859 |
| 2015/0258417 A1* | 9/2015 | Rodgers | A63B 71/085 | 128/861 |

* cited by examiner

*Primary Examiner* — Anna K Kinsaul
*Assistant Examiner* — Caitlin A Carreiro

(57) ABSTRACT

A water sports nasal guard prevents unwanted contaminated water from entering a user's nostrils. The water sports nasal guard includes a mouth guard, an upper tongue shield, a lower tongue shield, and a nostril shield. The mouth guard allows the user to bite down on the water sports nasal guard, thereby upholding the nostril shield against the nasal passages of the user. The nostril shield presses up against the openings of the user's nasal passages. The mouth guard further includes an arch-shaped body, an upper teeth receptacle, and a lower teeth receptacle. The arch-shaped body positions the upper teeth receptacle and the lower teeth receptacle opposite to each other, both of which accommodate the upper teeth and lower teeth of the user. The upper tongue shield and the lower tongue shield prevent the user's tongue from coming between the teeth of the user and the mouth guard.

8 Claims, 10 Drawing Sheets

WATER SPORTS NASAL GUARD

The current application claims a priority to the U.S. Provisional Patent application Ser. No. 62/244,874 filed on Oct. 22, 2015.

FIELD OF THE INVENTION

The present invention relates generally to protection equipment for water sports. More specifically, the present invention is a nasal plug mounted onto a mouth guard.

BACKGROUND OF THE INVENTION

The mouth guard is a piece of personal protective equipment used by athletes to protect their teeth and gums while engaging in physical activities. Traditionally, the mouth guard protects the teeth and gums from physical impact. Frequently, these devices are stand-alone pieces of equipment placed into a user's mouth and then removed when there is no longer a need for protection. For sports like football, the standard mouth guard is often modified to include a tether. This tether enables users to attach the mouth guard to their helmet, thus preventing the device from becoming lost.

An objective of the present invention is to improve upon the standard mouth guard by adding a water shield. This water shield prevents streams of water from entering a user's nose. The combined functionality of preventing contaminated water from entering the user's nose while being mounted within the user's mouth allows the present invention to be used in a variety of water sports. In active water sports such as water skiing, jet skiing, wake boarding, tubing, diving, etc., a participant is frequently subjected to unwanted water spray. The forcible injection of water into the nostrils and adjoining nasal cavities can not only cause discomfort, but more seriously, the potential for life threatening illness due to the introduction of deadly water borne organisms into the body. Athletes frequently wear mouth guards while engaging in these activities. Therefore, the present invention not only prevents injury, but improves the safety and enjoyment of anyone engaging in aquatic activities.

DETAILED DESCRIPTION OF THE INVENTION

All illustrations of the drawings are for the purpose of describing selected versions of the present invention and are not intended to limit the scope of the present invention.

Figure 1:
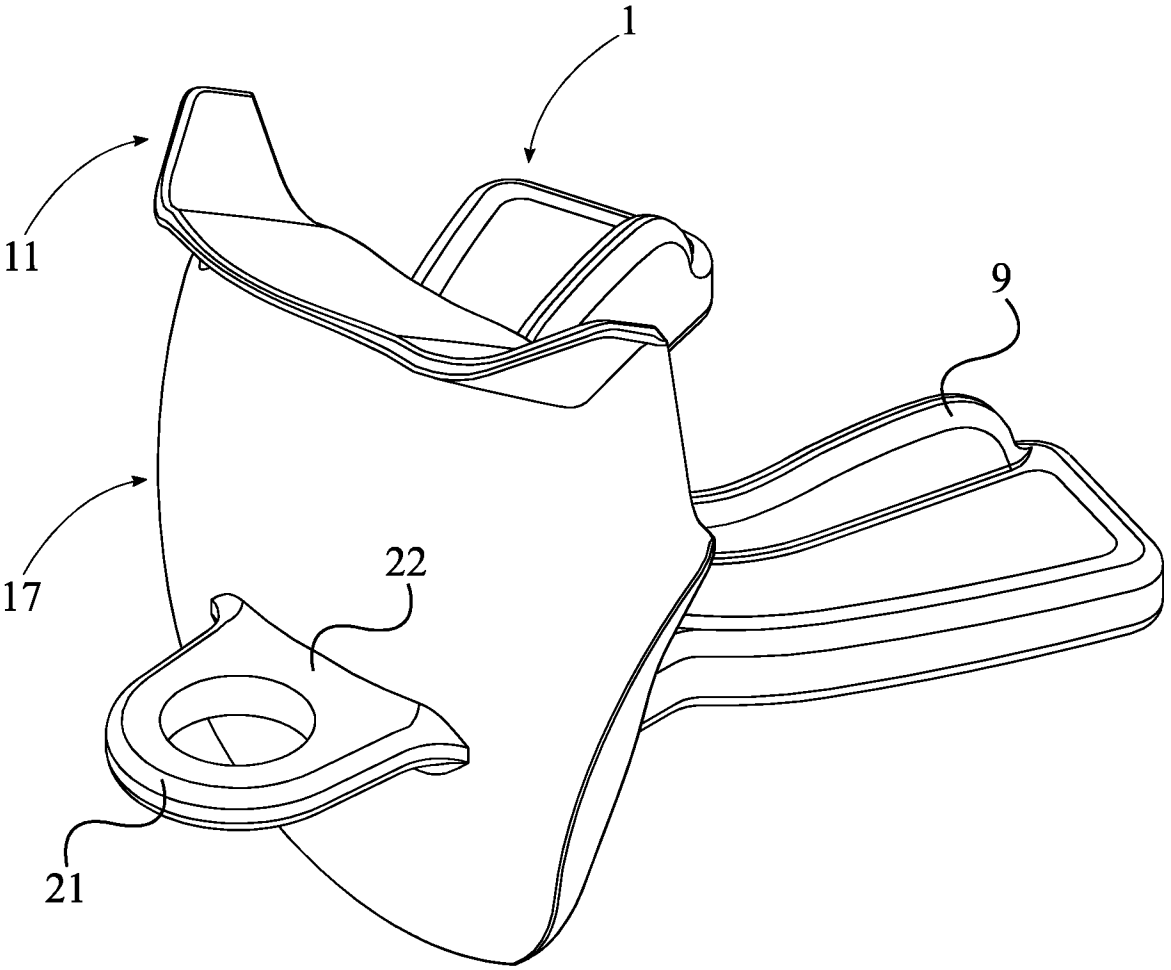
FIG. 1 is a perspective view of the present invention.
Figure 2:
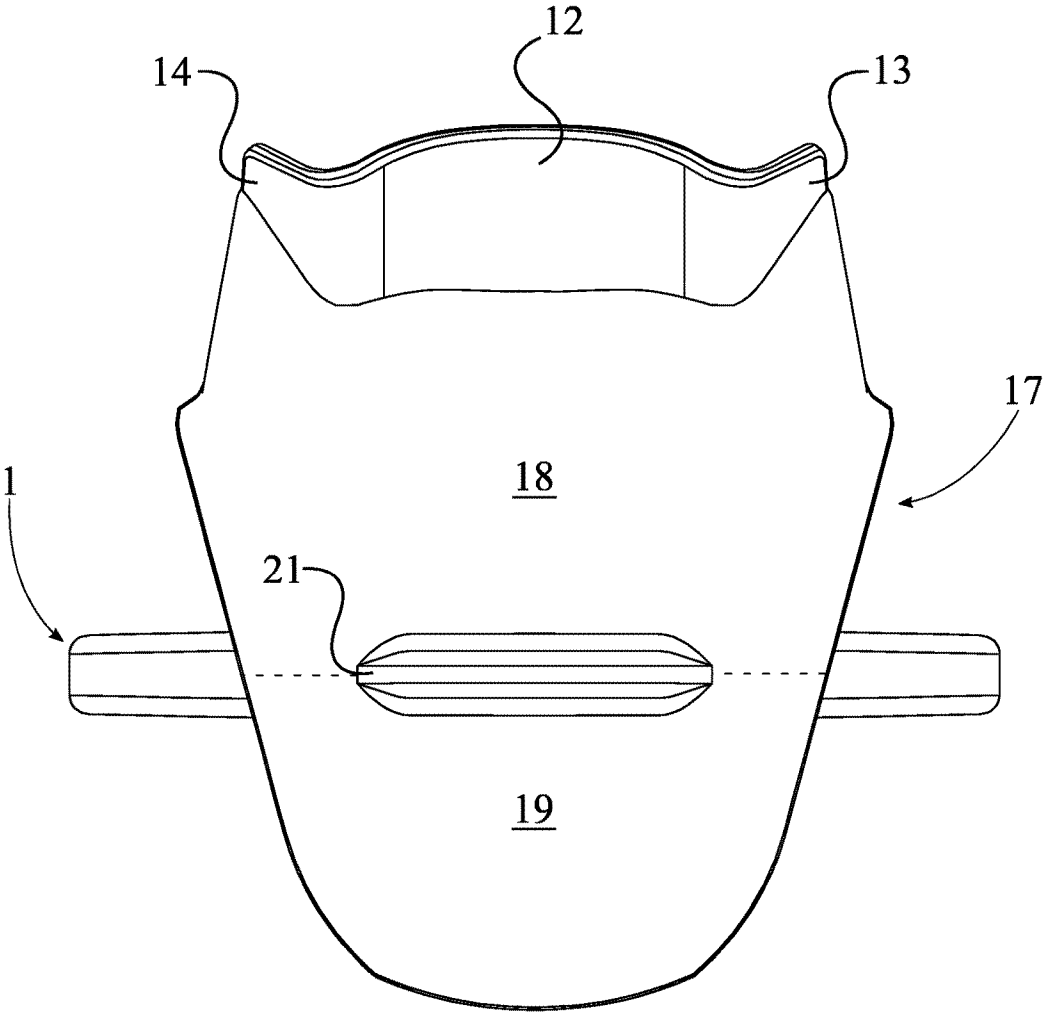
FIG. 2 is a front side view of the present invention.
Figure 4:
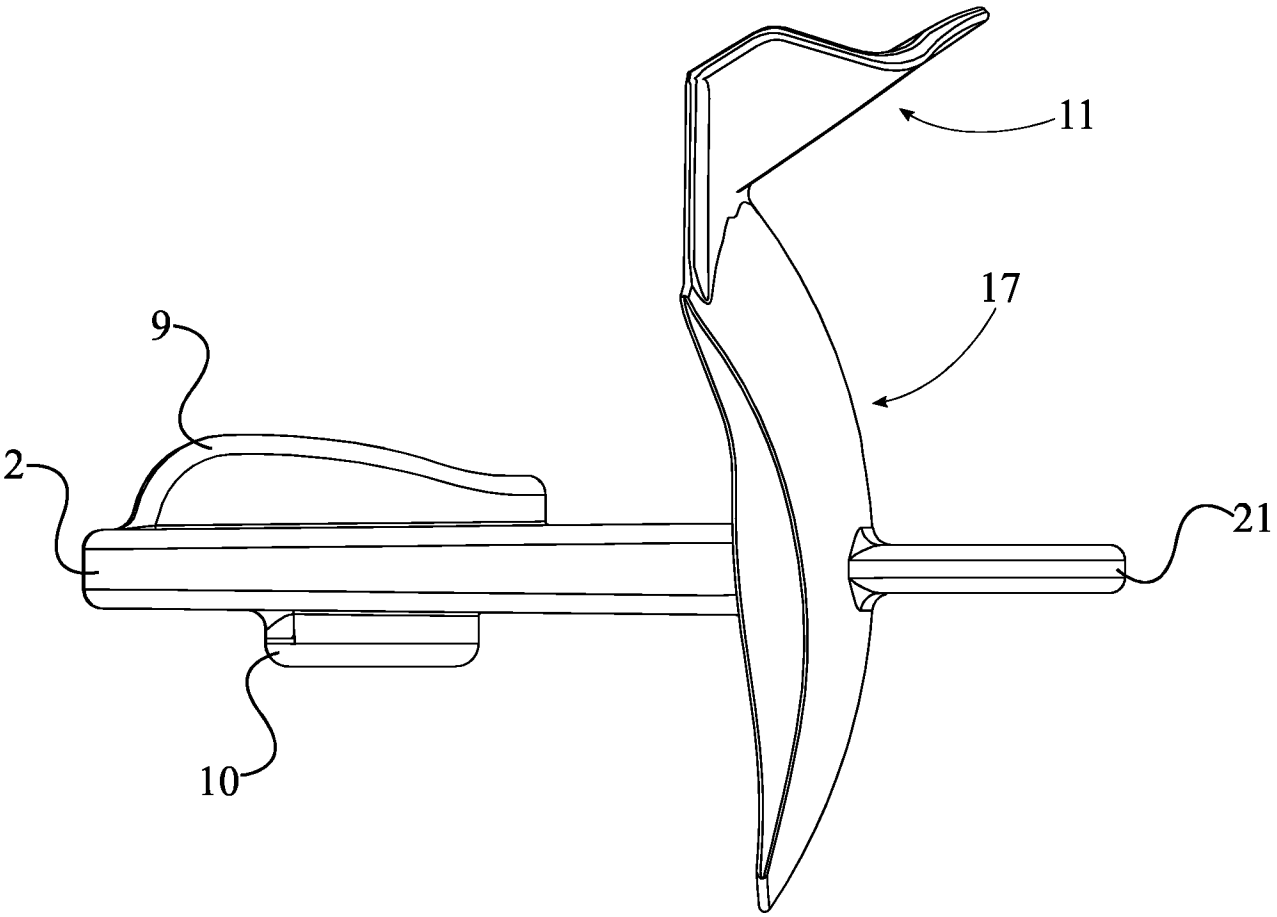
FIG. 4 is a left side view of the present invention.
Figure 5:
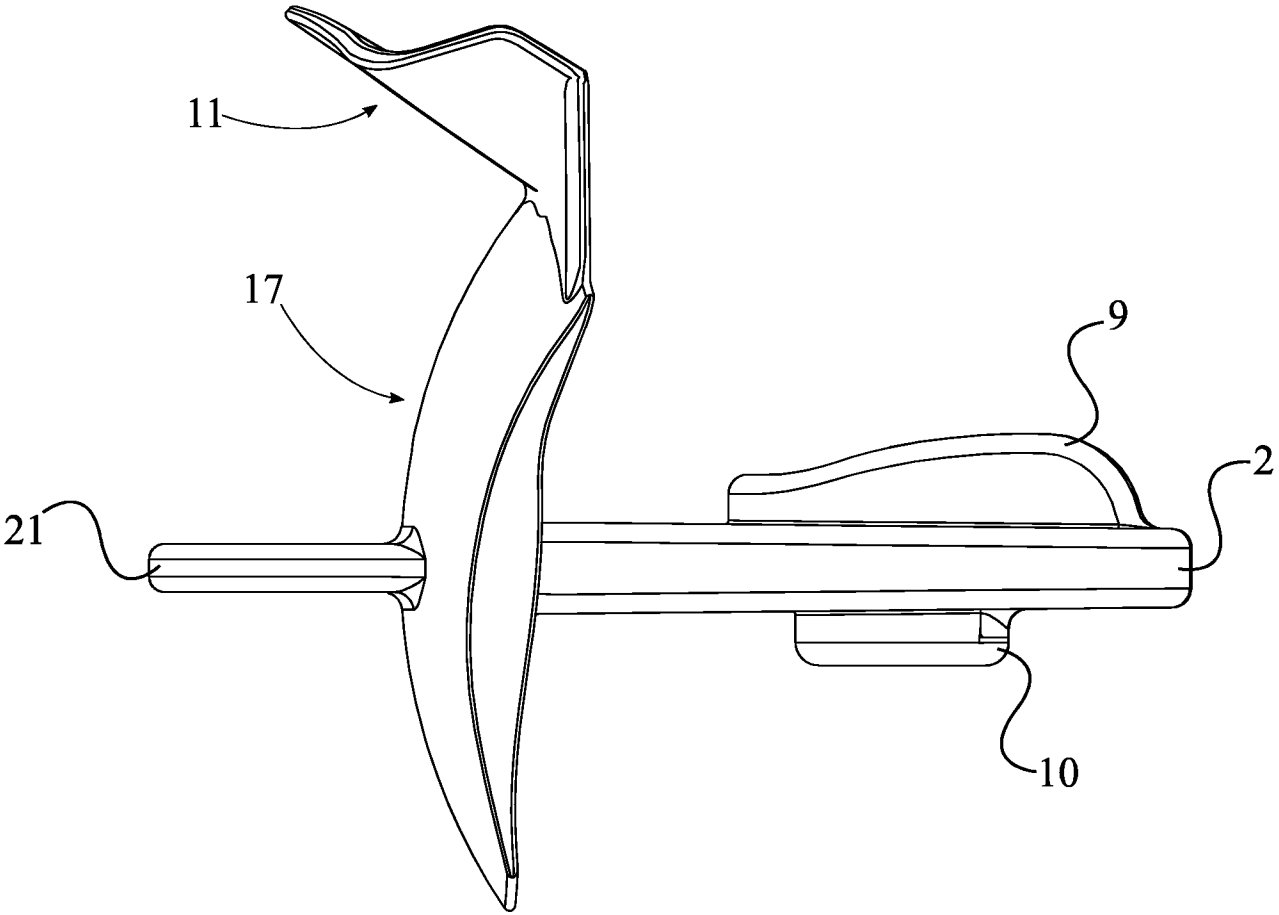
FIG. 5 is a right side view of the present invention.

The present invention is a water sports nasal guard that limits the risk of water uncontrollably flowing into the nasal passages. The present invention prevents injury and illness from contaminated water such as water containing the *Naegleria fowleri* amoeba. The present invention comprises a mouth guard 1, an upper tongue shield 9, a lower tongue shield 10, and a nostril shield 11, all of which are illustrated in the perspective view of FIG. 1 with the exception of the lower tongue shield 9. The lower tongue shield 10 is illustrated in the side views of FIG. 4 and FIG. 5. The mouth guard 1 allows a user to mount the present invention directly beneath and adjacent the user's nostrils. The upper tongue shield 9 and the lower tongue shield 10 prevents the user from accidentally biting down on his or her tongue. The nostril shield 11 protects the user's nasal passages, which may get exposed to contaminated water.

Figure 3:
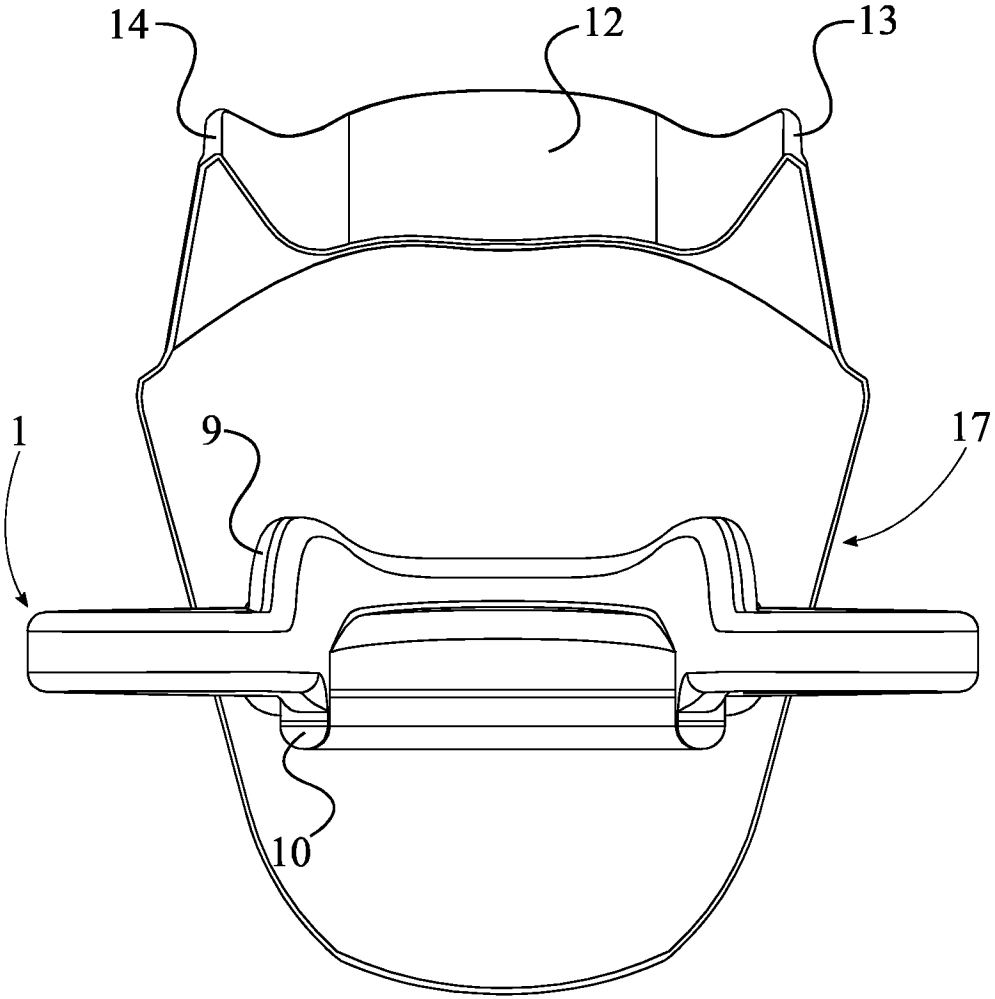
FIG. 3 is a back side view of the present invention.
Figure 6:
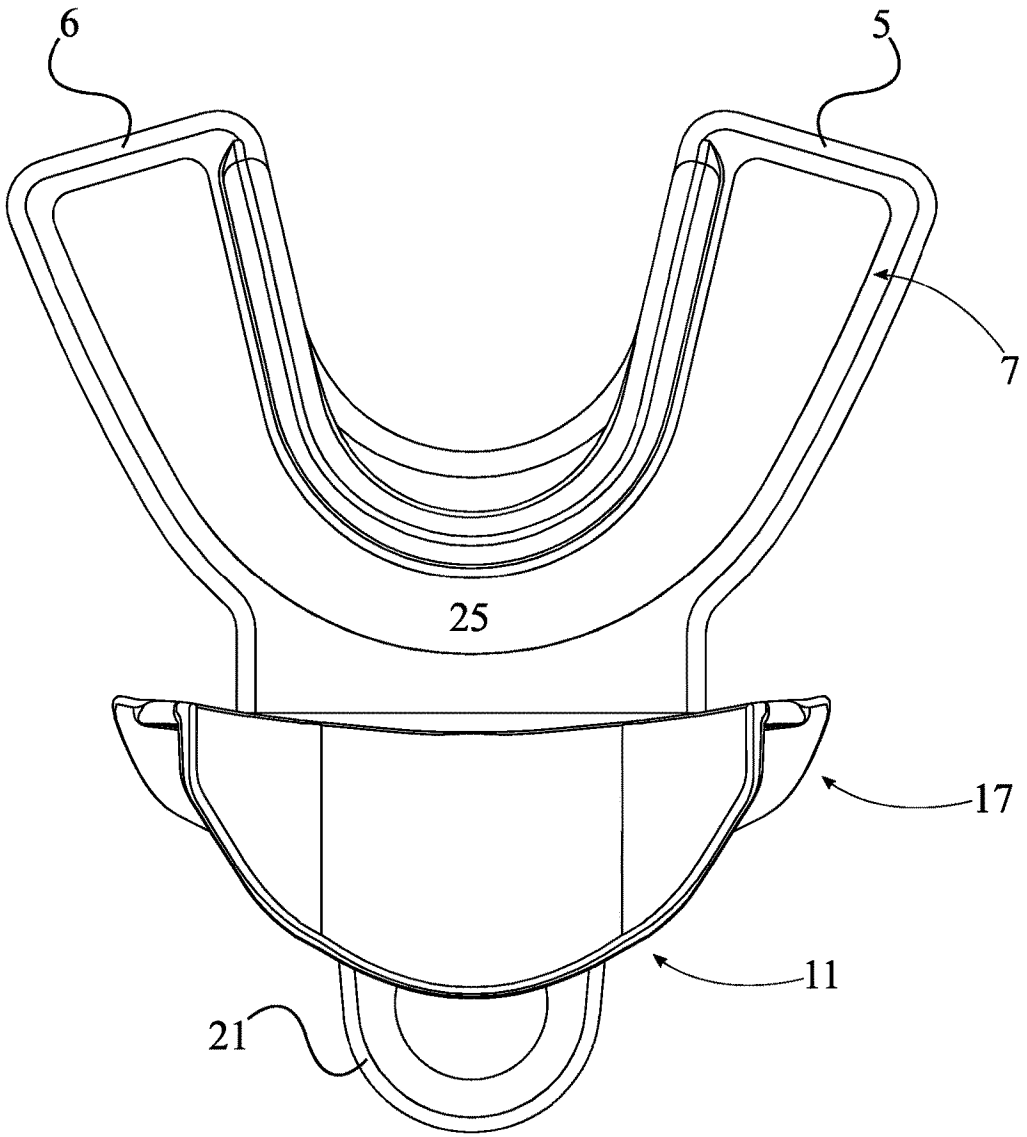
FIG. 6 is a top side view of the present invention.
Figure 8:
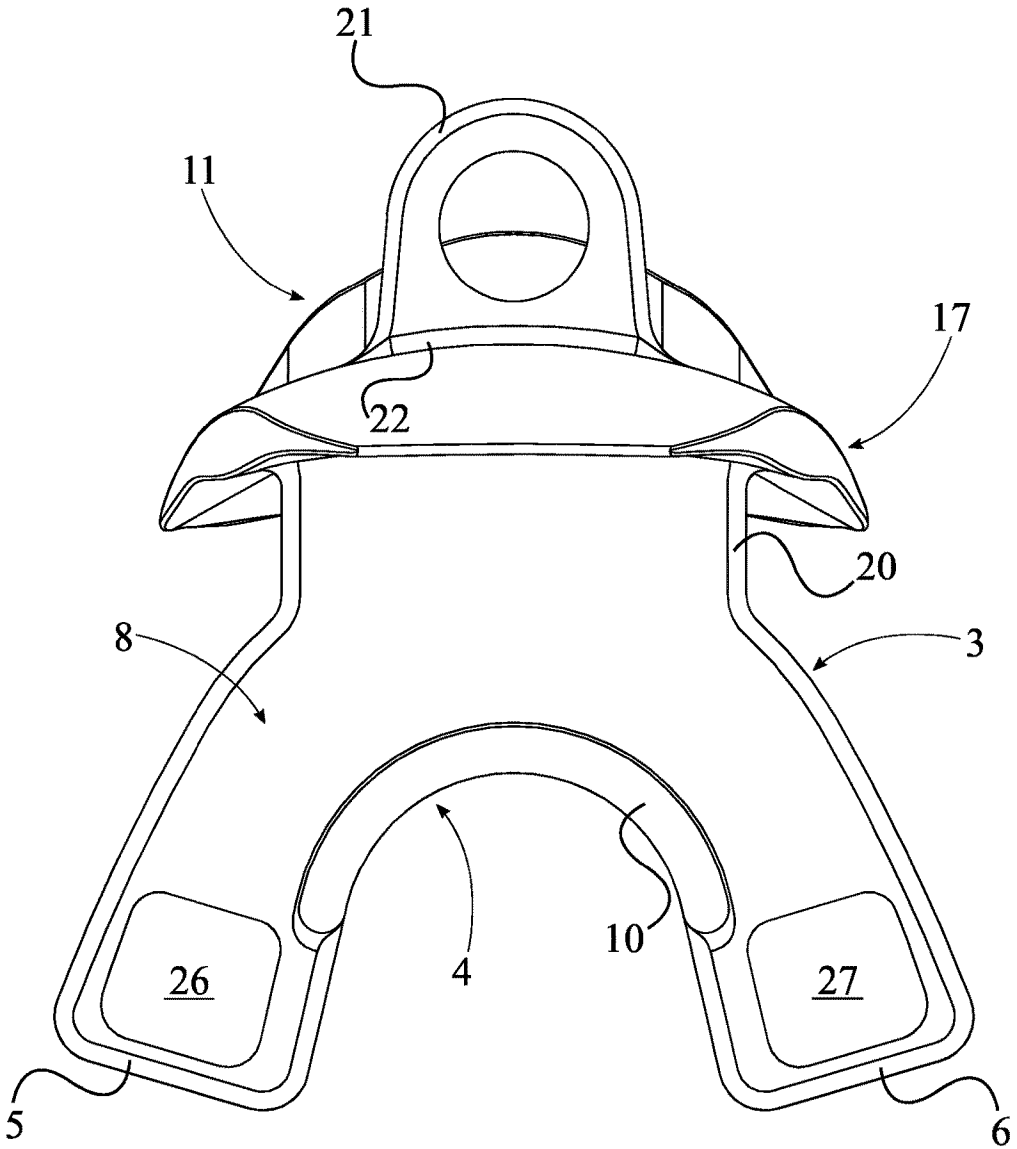
FIG. 8 is a bottom side view of the present invention.

The general configuration of the aforementioned components prevents contaminated water from entering the nasal passages of the user. The mouth guard 1 is placed within the mouth of the user and allows the user to bite down on the present invention. The mouth guard 1 comprises an arch-shaped body 2, an upper teeth receptacle 7, and a lower teeth receptacle 8. The upper teeth receptacle 7 and the lower teeth receptacle 8 are shown in the top view of FIG. 6 and the bottom view of FIG. 8, respectively. The upper teeth receptacle 7 and the lower teeth receptacle 8 defines the placement of the corresponding upper teeth and lower teeth of a user along the arch-shaped body 2 as the user bites down onto mouth guard 1. The arch-shaped body 2 comprises a convex portion 3, a concave portion 4, a first arch end 5, and a second arch end 6. The convex portion 3, the concave portion 4, the first arch end 5, and the second arch end 6 are used to shape the upper teeth receptacle 7 and the lower teeth receptacle 8. The arrangement of the convex portion 3, the concave portion 4, the first arch end 5, and the second arch end 6 is shown in FIG. 8. The upper teeth receptacle 7 traverses into the arch-shaped body 2, and the lower teeth receptacle 8 traverses into the arch-shaped body 2, opposite the upper teeth receptacle 7. The arrangement of the upper teeth receptacle 7 and the lower teeth receptacle 8 about the arch-shaped body 2 reflects the arrangement of teeth about the maxilla and mandible, respectively. The upper tongue shield 9 is connected to the arch-shaped body 2 along the concave portion 4, adjacent the upper teeth receptacle 7. Likewise, the lower tongue shield 10 is connected along the concave portion 4, adjacent to the lower teeth receptacle 8. This arrangement is shown in the back view of FIG. 3. The upper tongue shield 9 and the lower tongue shield 10 are oriented opposite to each other from the arch-shaped body 2. More specifically, the upper tongue shield 9 traverses about the concave portion 4 from the first arch end 5 to the second arch end 6, and the lower tongue shield 10 traverse about the concave portion 4 between the first arch end 5 and the second arch end 6. This configuration prevents the user's tongue from accidentally extending forward between his or her teeth into either the upper teeth receptacle 7 or the lower teeth receptacle 8. The nostril shield 11 is mounted adjacent convex portion 3 of the arch-shaped body 2. This allows the nostril shield 11 to press against the openings of the nasal passages so that contaminated water is not able to enter the user's nose and cause the user any harm.

The present invention further comprises a mouth shield 17 and a first extension arm 20. The mouth shield 17 upholds the nostril shield 11 just below the nose of the user. The first extension arm 20 connects the mouth shield 17 to the arch-shaped body 2. More specifically, the first extension arm 20 is connected adjacent to the convex portion 3, and the mouth shield 17 is connected adjacent to the first extension arm 20, opposite the convex portion 3. This configuration positions the nostril shield 11 in front of the user's face. The nostril shield 11 is connected adjacent the mouth shield 17, offset from the first extension arm 20 so that the nostril shield 11 presses up against the openings of the user's nasal passages.

The mouth shield 17 further comprises a maxilla portion 18 and a mandible portion 19. The maxilla portion 18 covers the maxilla of the user's jaw, and the mandible portion 19 covers the mandible of the user's jaw. The maxilla portion 18 is positioned adjacent the upper teeth receptacle 7, and the mandible portion 19 is positioned adjacent the lower teeth receptacle 8. The arrangement of the maxilla portion 18 and the mandible portion 19 deflects the flow of contaminated water towards the opening of the user's mouth. More specifically, the nostril shield 11 is positioned adjacent the maxilla portion 18, opposite to the mandible portion 19, thereby positioning the nostril shield 11 directly under the user's nose.

The present invention further comprises a tether coupler 21 and a second extension arm 22. The tether coupler 21 engages with a tether or comparable fastener so that the user may attach the present invention to a variety of anchoring points. The second extension arm 22 upholds the tether coupler 21 against nostril shield 11. More specifically, the second extension arm 22 is connected adjacent to the convex portion 3, and the tether coupler 21 is connected adjacent to the second extension arm 22, opposite to the convex portion 3. This configuration allows a user to attach a tether to the tether coupler 21 while the mouth guard 1 is within the user's mouth.

Figure 7:
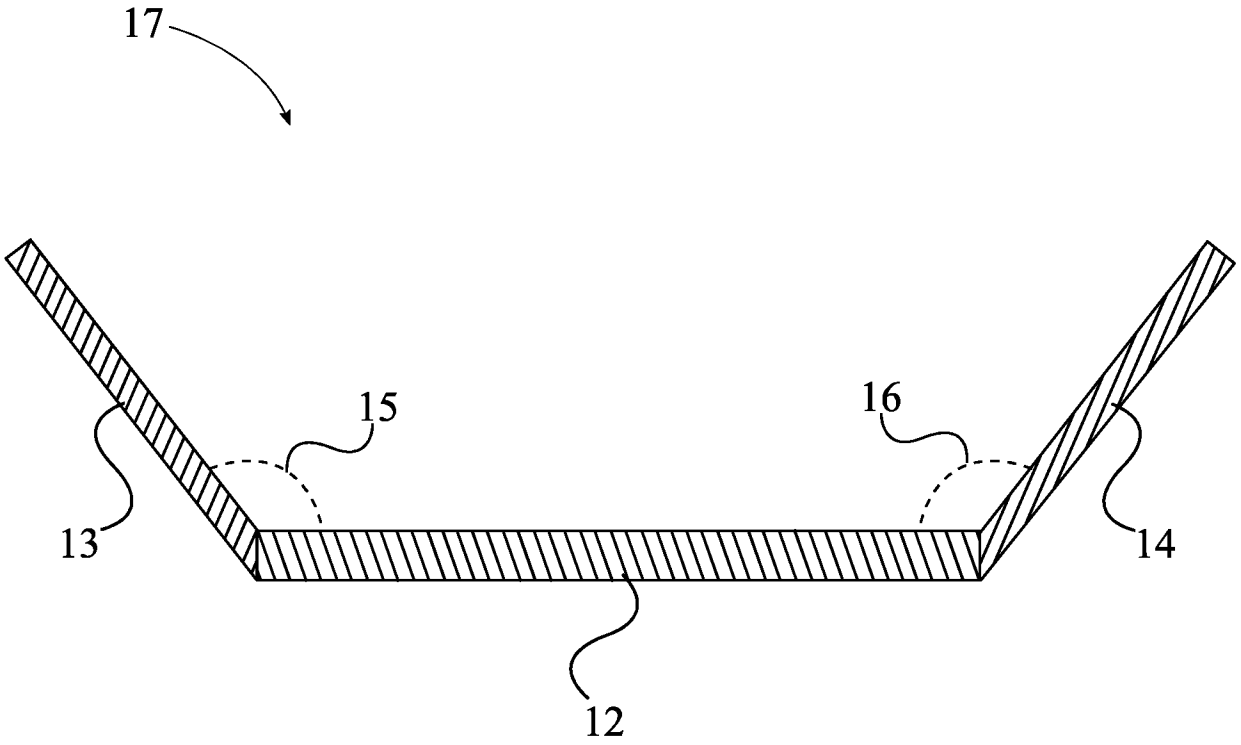
FIG. 7 is a schematic view of the nostril shield of the present invention.

In order to properly block the openings of the nasal passages, the nostril shield 11 comprises a main plate 12, a first sill-bracing plate 13, and a second sill-bracing plate 14. The main plate 12 covers both of the openings of the user's nasal passages. The first sill-bracing plate 13 and the second sill-bracing plate 14 cover the sides of the nose of the user so that the force of incoming contaminated water does not push the main plate 12 away from the openings of the user's nasal passages. Consequently, the first sill-bracing plate 13 is connected adjacent to the main plate 12, and the second sill-bracing plate 14 is connected adjacent to the main plate 12, opposite to the first sill-bracing plate 13. More specifically, the first sill-bracing plate 13 is oriented at a first obtuse angle 15 with the main plate 12. Similarly, the second sill-bracing plate 14 is oriented at a second obtuse angle 16 with the main plate 12. The orientation of the first-sill bracing plate 13 and the second sill-bracing plate 14 with that of the main plate 12 is shown in the schematic view of FIG. 7. In the preferred embodiment of the present invention, the first obtuse angle 15 and the second obtuse angle 16 are equal to each other. The orientation of the first sill-bracing plate 13 and the second sill-bracing plate 14 with the main panel accommodates the bilateral symmetry of a user's nostrils.

Figure 9:
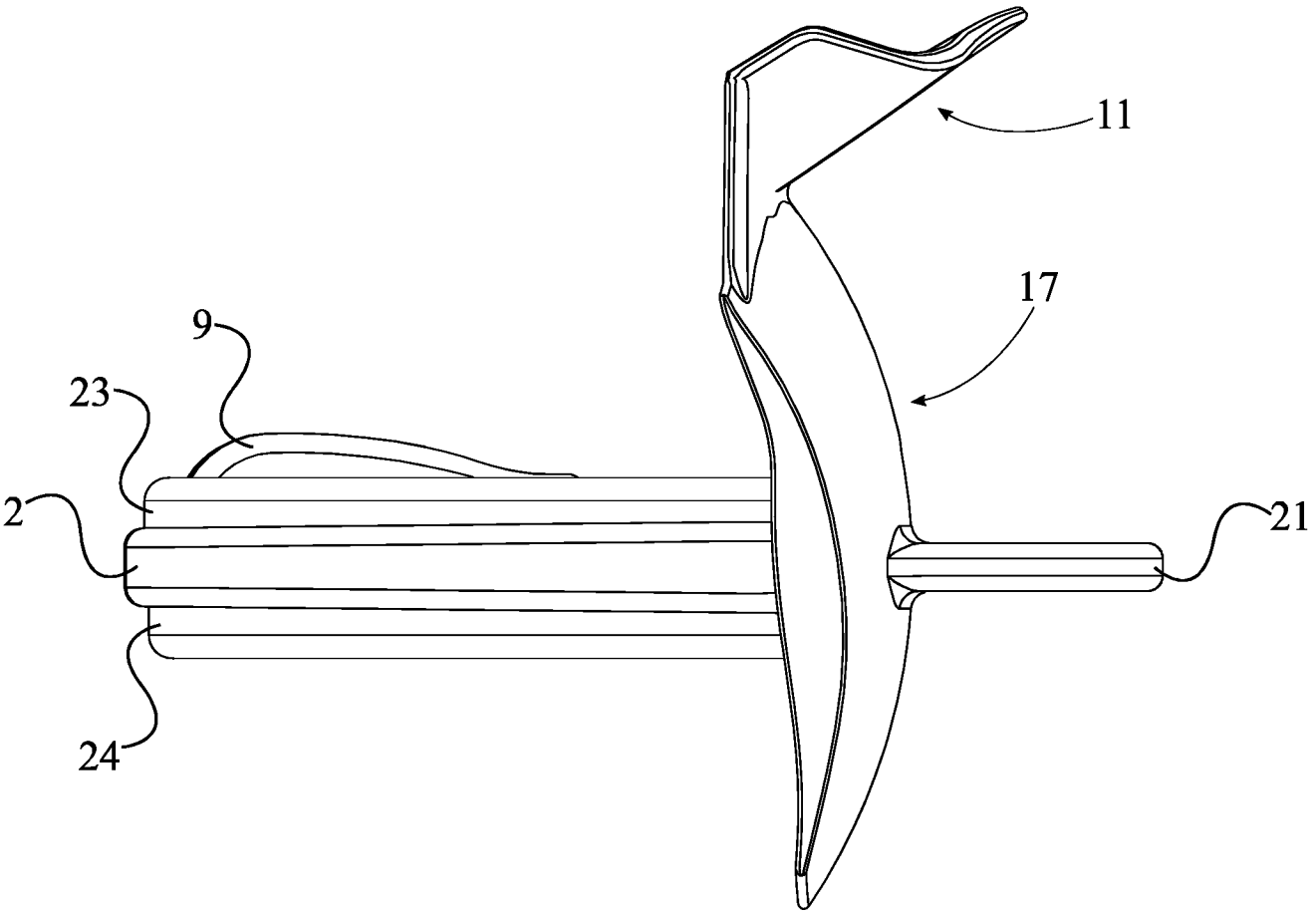
FIG. 9 is a left side view of the upper lip ridge and the lower lip ridge of an alternate embodiment of the present invention.
Figure 10:
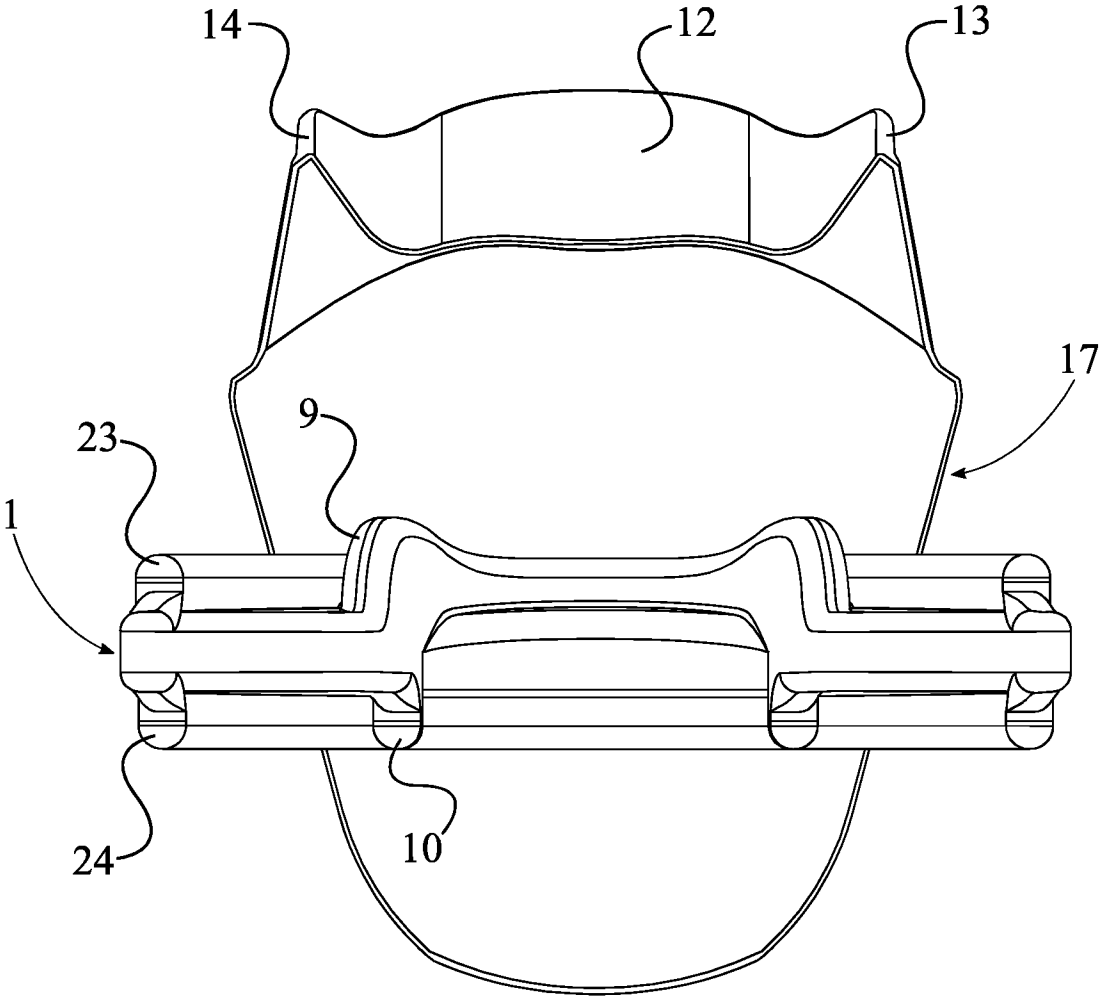
FIG. 10 is a back side view of the upper lip ridge and the lower lip ridge of the alternate embodiment of the present invention.

An embodiment of the present invention further comprises an upper lip ridge 23 and a lower lip ridge 24, illustrated in FIG. 9. The upper lip ridge 23 covers the upper lip of the user, and the lower lip ridge 24 covers the lower lip of the user. The upper lip ridge 23 is connected along the convex portion 3, adjacent to the upper teeth receptacle 7. Consequently, the lower lip ridge 24 is connected along the convex portion 3, adjacent the lower teeth receptacle 8. This configuration lessens the impact of incoming contaminated water towards the mouth of the user and is shown in the back view of FIG. 10.

In order to better accommodate a variety of user's teeth arrangement and jaw, an embodiment of the arch-shaped body 2 is uniformly made of a moldable material. The moldable material conforms to the bite of the user, and therefore, the entire arch-shaped body 2 is not limited to any one type of jaw or bite. The preferred moldable material is a medical grade silicone. The moldable material can also be, but is not limited to, a variety of durometer and grades of liquid silicone rubber, thermoplastic resins and rubbers, and urethane resins. An alternate embodiment of the present invention comprises an upper quantity of moldable material 25. The upper quantity of moldable material 25 conforms like that of the preferred embodiment, but is limited to a specific area. The upper quantity of moldable material 25 deforms to the contours of the upper teeth of the user that presses against the arch-shaped body 2. More specifically, the upper quantity of moldable material 25 is integrated across a base surface of the upper teeth receptacle 7, shown in FIG. 6, so that upper teeth receptacle 7 adapts to the contours of the upper teeth of the user. This alternate embodiment further comprises a first lower quantity of moldable material 26 and a second lower quantity of moldable material 27. The first lower quantity of moldable material 26 and the second lower quantity of moldable material 27 also conform like that of the preferred embodiment, but are limited to a specific area. The first lower quantity of moldable material 26 and the second lower quantity of moldable material 27 deform to the contours of the molars that press against the arch-shaped body 2. The first lower quantity of moldable material 26 is integrated into a base surface of the lower teeth receptacle 8, adjacent to the corresponding first arch end 5. The second lower quantity of moldable material 27 is integrated into a base surface of the lower teeth receptacle 8, adjacent to the second arch end 6. The arrangement of the first lower quantity of moldable material 26 and the second lower quantity of moldable material 27 about the lower teeth receptacle 8 lessens the pressure of the lower teeth against the mouth guard 1. This arrangement is shown in the bottom view of FIG. 8. More specifically, the first lower quantity of moldable material 26 and the second lower quantity of moldable material 27 accommodate the pressure of the molars of the lower teeth of the user as the molars create the most amount of pressure in the bite of the user.

In addition, as shown in FIGS. 3-6 and 8-10, an arc length of the upper tongue shield 9 is larger than an arc length of the lower tongue shield 10 by the upper tongue shield 9 extending to the first arch end 5 and to the second arch end 6 and the lower tongue shield 10 not extending to the first arch end 5 and to the second arch end 6; as shown in FIGS. 1-10, the main plate 12 has no opening formed thereon so as to be configured to fully cover a user's nasal passages.

Although the invention has been explained in relation to its preferred embodiment, it is to be understood that many other possible modifications and variations can be made without departing from the spirit and scope of the invention as hereinafter claimed.

What is claimed is:

1. A water sports nasal guard comprising:

a mouth guard;

an upper tongue shield;

a lower tongue shield;

a nostril shield;

the mouth guard comprising an arch-shaped body, an upper teeth receptacle and a lower teeth receptacle;

the arch-shaped body comprising a convex portion, a concave portion, a first arch end and a second arch end;

the upper teeth receptacle traversing into the arch-shaped body;

the lower teeth receptacle traversing into the arch-shaped body, opposite to the upper teeth receptacle;

the upper tongue shield being connected along the concave portion, adjacent to the upper teeth receptacle;

the lower tongue shield being connected along the concave portion, adjacent to the lower teeth receptacle;

the nostril shield being mounted adjacent to the convex portion;

the upper tongue shield and the lower tongue shield being oriented opposite to each other from the arch-shaped body;

the upper tongue shield traversing about the concave portion from the first arch end to the second arch end;

the lower tongue shield traversing about the concave portion between the first arch end and the second arch end;

an arc length of the upper tongue shield being larger than an arc length of the lower tongue shield by the upper tongue shield extending to the first arch end and to the second arch end and the lower tongue shield not extending to the first arch end and to the second arch end;

the nostril shield comprising a main plate, a first sill-bracing plate and a second sill-bracing plate;

the first sill-bracing plate being connected adjacent to the main plate;

the second sill-bracing plate being connected adjacent to the main plate, opposite to the first sill-bracing plate;

the first sill-bracing plate being oriented at a first obtuse angle with the main plate;

the second sill-bracing plate being oriented at a second obtuse angle with the main plate;

the first obtuse angle and the second obtuse angle being equal to each other; and the main plate having no opening formed thereon so as to be configured to fully cover a user's nasal passages.

2. The water sports nasal guard as claimed in claim 1 further comprising:

a mouth shield;

an extension arm;

the extension arm being connected adjacent to the convex portion;

the mouth shield being connected adjacent to the extension arm, opposite to the convex portion; and the nostril shield being connected adjacent to the mouth shield, offset from the extension arm.

3. The water sports nasal guard as claimed in claim 2 further comprising:

the mouth shield comprising a maxilla portion and a mandible portion;

the maxilla portion being positioned adjacent to the upper teeth receptacle;

the mandible portion being positioned adjacent to the lower teeth receptacle; and the nostril shield being positioned adjacent to the maxilla portion, opposite to the mandible portion.

4. The water sports nasal guard as claimed in claim 1 further comprising:

a tether coupler;

an extension arm;

the extension arm being connected adjacent to the convex portion; and the tether coupler being connected adjacent to the extension arm, opposite to the convex portion.

5. The water sports nasal guard as claimed in claim 1 further comprising:

an upper lip ridge;

a lower lip ridge;

the upper lip ridge being connected along the convex portion, adjacent to the upper teeth receptacle; and the lower lip ridge being connected along the convex portion, adjacent to the lower teeth receptacle.

6. The water sports nasal guard as claimed in claim 1 further comprising:

the arch-shaped body being uniformly made of a moldable material.

7. The water sports nasal guard as claimed in claim 1 further comprising:

an upper quantity of moldable material; and the upper quantity of moldable material being integrated across a base surface of the upper teeth receptacle.

8. The water sports nasal guard as claimed in claim 1 further comprising:

a first lower quantity of moldable material;

a second lower quantity of moldable material;

the first lower quantity of moldable material being integrated into a base surface of the lower teeth receptacle, adjacent to the first arch end; and the second lower quantity of moldable material being integrated into a base surface of the lower teeth receptacle, adjacent to the second arch end.

* * * * *